US010052533B1

(12) United States Patent
Kuc

(10) Patent No.: US 10,052,533 B1
(45) Date of Patent: Aug. 21, 2018

(54) DISTANCE ENHANCING HEAD FOR A GOLF CLUB

(71) Applicant: Russell G. Kuc, Mishawaka, IN (US)

(72) Inventor: Russell G. Kuc, Mishawaka, IN (US)

( * ) Notice: Subject to any disclaimer, the term of this patent is extended or adjusted under 35 U.S.C. 154(b) by 0 days.

(21) Appl. No.: 15/954,055

(22) Filed: Apr. 16, 2018

Related U.S. Application Data

(60) Provisional application No. 62/558,961, filed on Sep. 15, 2017.

(51) Int. Cl.
*A63B 53/08* (2015.01)
*A63B 53/04* (2015.01)

(52) U.S. Cl.
CPC ..... *A63B 53/0466* (2013.01); *A63B 53/08* (2013.01); *A63B 2053/042* (2013.01); *A63B 2053/0416* (2013.01); *A63B 2053/0425* (2013.01); *A63B 2053/0429* (2013.01); *A63B 2053/0441* (2013.01); *A63B 2053/0491* (2013.01)

(58) Field of Classification Search
CPC .... A63B 2053/0416; A63B 2053/0491; A63B 2053/042; A63B 2053/0425; A63B 2053/0429; A63B 53/0466; A63B 53/08
USPC ..... 473/342, 329, 330, 332, 337, 336, 335, 473/340, 341, 343, 345
See application file for complete search history.

(56) References Cited

U.S. PATENT DOCUMENTS 700,946 A * 5/1902 Kempshall ..... A63B 53/0466 473/329
2,968,486 A * 1/1961 Walton ..... A63B 53/04 473/329
3,937,474 A * 2/1976 Jepson ..... A63B 53/04 473/342
4,749,197 A * 6/1988 Orlowski ..... A63B 53/04 473/342
4,804,188 A * 2/1989 McKee ..... A63B 53/04 473/342
4,812,187 A * 3/1989 Honma ..... A63B 53/04 156/245
5,046,740 A * 9/1991 D'Eath ..... A63B 53/0487 473/255
5,141,231 A 8/1992 Cox
5,299,807 A * 4/1994 Hutin ..... A63B 53/04 473/329
5,362,055 A * 11/1994 Rennie ..... A63B 53/04 473/342
6,102,813 A * 8/2000 Dill ..... A63B 53/04 473/305

* cited by examiner

*Primary Examiner* — Benjamin Layno
(74) *Attorney, Agent, or Firm* — Dunlap Bennett & Ludwig PLLC; Brendan E. Squire

(57) ABSTRACT

An enhanced club head for a golf club that improves the distance achieved on a golf shot. 'Metal head' golf clubs, such as drivers, fairway metals, and hybrids have metallic sidewalls defining an interior cavity of the club head. A clubface of the metal head is enhanced by inserting a plurality of screws in a spaced apart relation to improve the sweet spot of clubface. It is believed that the plurality of screws in the clubface reduces the deflection of the clubface when the club strikes the golf ball, thereby imparting greater energy into the ball to obtain a greater distance.

20 Claims, 4 Drawing Sheets

DISTANCE ENHANCING HEAD FOR A GOLF CLUB

CROSS-REFERENCE TO RELATED APPLICATION

This application claims the benefit of priority of U.S. provisional application No. 62/558,961, filed Sep. 15, 2017, the contents of which are herein incorporated by reference.

BACKGROUND OF THE INVENTION

The present invention relates to golf clubs, and more particularly to metal golf club heads of the type commonly referred to as woods and hybrid irons.

Golf is an extremely popular and lucrative sport all over the world. All golfers, no matter what their ability, want longer distance shots from their golf equipment, particularly from the tee box and fairway shots. Existing golf club designs limit the distance any golfer can hit the ball, especially for amateur golfers.

'Metal head' golf clubs, such as drivers, fairway metals, and hybrids look alike. These clubs have a solid, flat face that may be somewhat convex, with a plurality of horizontal spaced apart grooves defined in the clubface. When the golf club head strikes the ball, the metal face deflects on impact and absorbs some of the energy of the swing, thus reducing the golf ball distance.

As can be seen, there is a need for an improved golf club that can obtain longer distance from their golf swing.

SUMMARY OF THE INVENTION

In one aspect of the present invention a golf club head includes a body having an exterior sidewall defining an interior cavity. A heel is configured to receive a first end of an elongate shaft. A clubface is defined on an anterior portion of the body oriented for striking a golf ball. A plurality of screws are disposed in a geometric pattern on the clubface. The plurality of screws are received in a plurality of threaded, countersunk holes defined through the clubface and a head of each of the plurality of screws is substantially coplanar with the clubface. The plurality of screws have a length at least as long as a depth of the plurality of holes.

A sweet spot is defined in a median portion of the clubface and the plurality of screws are disposed in the geometric pattern about the sweet spot.

In some embodiments, the geometric pattern is a diamond. A long axis of the diamond is defined in a vertical orientation along a vertical centerline of the sweet spot and a lateral axis of the diamond is defined along a lateral centerline of the sweet spot.

In other embodiments, the geometric pattern is a triangle. A base and legs of the triangle are inscribed within the boundaries of the sweet spot. The base aligned laterally across the bottom of the sweet spot. An apex of the triangle may be aligned with a vertical centerline of the sweet spot.

In some other embodiments, the geometric is a diamond pattern, with a long axis of the diamond that extends across a lateral centerline of the sweet spot and a vertical axis of the diamond is aligned with a vertical axis of the sweet spot.

In yet other embodiments, the geometric pattern on the club face includes a first geometric shape and a second geometric shape that are disposed on either side of a vertical center line of the sweet spot. The first geometric shape and the second geometric shape may be triangles, with a base of the triangles aligned with a vertical centerline of the sweet spot and vertices opposite the base aligned along a horizontal centerline of the sweet spot.

In other embodiments, the geometric shape is a rectangle, with an upper end of the rectangle positioned above a lateral centerline of the sweet spot, a bottom end of the rectangle positioned below the lateral centerline of the sweet spot. A left side and a right side of the rectangle positioned on opposite sides of a vertical centerline of the sweet spot.

In other aspects of the invention, a golf club is disclosed. The golf club includes a club head having an exterior sidewall defining an interior cavity, a heel, and a clubface on an anterior portion of the clubface oriented for striking a golf ball. An elongate shaft has a first end and a second end, where the first end is received in the heel and a grip is applied on the second end. A sweet spot is defined in a median portion of the clubface. A plurality of screws are received in the clubface and are disposed in a geometric pattern about the sweet spot.

The plurality of screws are received in a plurality of threaded holes defined in the clubface. A head of each of the plurality of screws is substantially coplanar with the clubface. The plurality of screws may have a length at least as long as a depth of the plurality of holes.

The geometric pattern may be a diamond, wherein a long axis of the diamond is defined in a vertical orientation along a vertical centerline of the sweet spot and a lateral axis of the diamond is defined along a lateral centerline of the sweet spot.

In some embodiments, the geometric pattern may be a triangle, wherein a base and legs of the triangle are inscribed within the boundaries of the sweet spot, a the base aligned laterally across the bottom of the sweet spot. An apex of the triangle is aligned with a vertical centerline of the sweet spot.

In other embodiments, the geometric pattern is a diamond pattern, wherein a long axis of the diamond extends across a lateral centerline of the sweet spot, and a vertical axis of the diamond is aligned with a vertical axis of the sweet spot.

In yet other embodiments the geometric pattern includes a first geometric shape and a second geometric shape disposed on either side of a vertical center line of the sweet spot. The first geometric shape and the second geometric shape may be triangles, with a base of the triangles aligned with a vertical centerline of the sweet spot and vertices opposite the base aligned along a horizontal centerline of the sweet spot.

In other embodiments, the geometric pattern may be a rectangle, with an upper end of the rectangle positioned above a lateral centerline of the sweet spot, a bottom end of the rectangle positioned below the lateral centerline of the sweet spot; and a left side and a right side of the rectangle positioned on opposite sides of a vertical centerline of the sweet spot.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention is an improved head for a golf club having a plurality of spaced apart metal screws embedded on a ball contact surface, or face of the club head. The plurality of screws in the club face reduces the club face deflection, allowing more energy transfer between the club and the ball. The result is a further flying ball.

Figure 1:
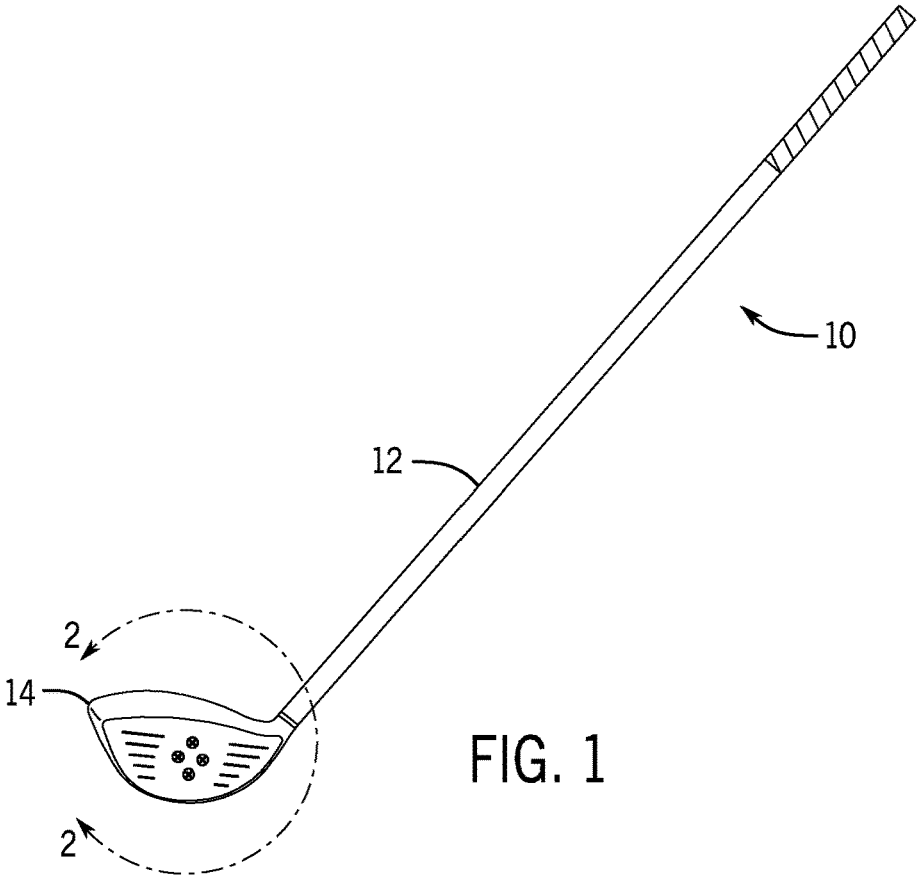
FIG. 1 is front elevation view of a golf club.

As seen in reference to FIG. 1, a golf club 10 according to aspects of the invention includes an elongate shaft 12 having a first end and a second end. A club head 14 is defined at a first end of the elongate shaft and grip is disposed around the second end of the shaft. The shaft 12 is received in the head 14 at a heel of the club head 14 to rigidly attach the club head 14 to the shaft 12.

Figure 2:
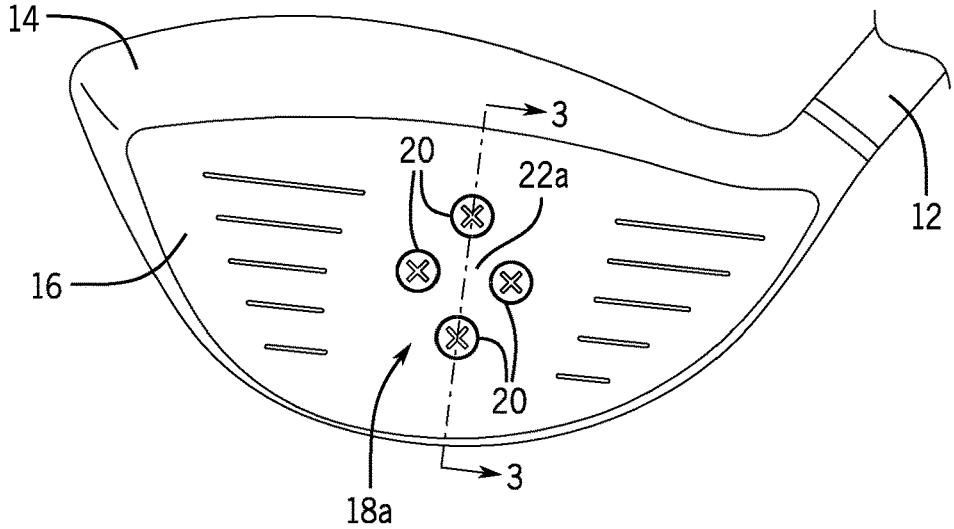
FIG. 2 is a detail front elevation view of the head of the golf club, indicated by line 2-2 of FIG. 1, showing a first embodiment of the clubface.
Figure 3:
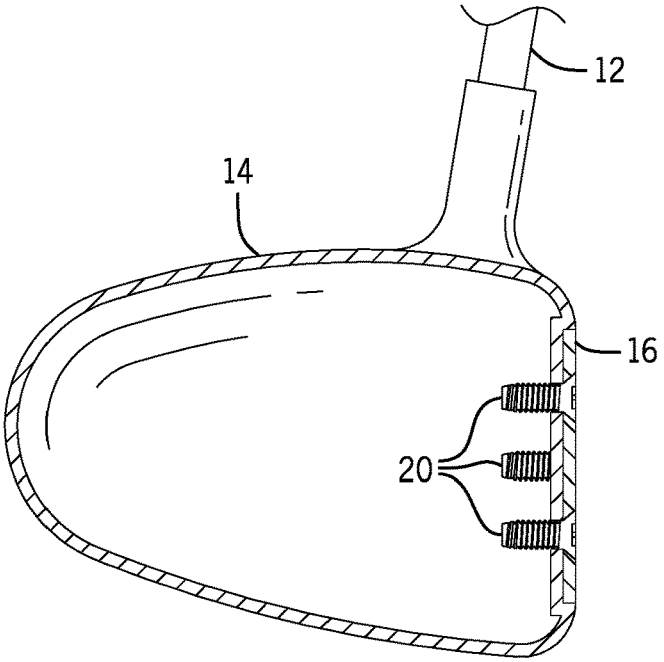
FIG. 3 is a cross-sectional view taken on line 3-3 of FIG. 2.

As seen in reference to FIGS. 2 and 3, the club head 14 of a "metal head" golf club is formed as a substantially hollow body having a sidewall formed of a metallic material. The sidewall of the club head 14 defines an interior cavity of the club head 14. The club head 14 has a clubface 16 defined along an anterior portion of the head 14. In some instances, the clubface 16 may also include of a metallic strike plate that is received within a recess of the clubface 16 and may be secured to the club head 14 via an adhesive, or weld. The clubface 16 has a sweet spot defined at a medial portion of the clubface 16 and represents the preferred spot at which the golf ball is struck by the golfer during a golf swing.

The higher handicap golfer does not swing the club in a consistent manner to always strike the ball in the 'sweet spot'. Thus, the off-center shot result is a shorter distance. Advantageously, the current invention allows longer ball flight, regardless of the golfer's ability. Placing screws in the club face expands the sweet spot, permitting even off-center shots to travel a farther distance.

As seen in reference to the drawings of FIGS. 2-8, the club head 14 according to aspects of the invention includes the addition of a plurality of screws 20 that are threadingly received in the clubface 16 of the metal head club in a spaced apart relation. The holes and the plurality of screws 20 may extend through the club face 16. It is believed that the addition of the plurality of screws 20 reduces the deflection of the clubface 16 as the club 10 strikes the golf ball. Because the energy is not expended in deflecting the clubface 16, that energy is available to be imparted to the golf ball to achieve a longer distance.

The plurality of screws may include up to six flat head screws 20 "or more flat head screws depending on the club head 14 design. The plurality of screws 20 are placed in the clubface 16 of the driver, fairway metal, or hybrid iron. Preferably, the screws 20 are placed on the sweet spot 22*a*-22*f* of the clubface 16 in a geometric pattern 18*a*-18*f*. The geometric pattern for a particular club head 14 design may be determined by using a mechanical swing machine, or may best be determined by each golf club manufacturer's internal engineering, design teams and research and development data. The pattern may also be selected based on the golfer's swing characteristics, as determined by a golf pro. The geometric pattern may include but is not limited to a square, an oval, a star, a line or lines, in one or more of a vertical, a horizontal, a diagonal orientation. As shown in the embodiment of FIGS. 2-8, the plurality of screws 20 are positioned in various geometric patterns about the sweet spot 22*a*-22*f* of the clubface 16.

To make the club head 14, a plurality of holes are drilled "may be drilled, punched, forged or cast" into the clubface 16 in a defined geometric pattern. Then the plurality of holes are tapped and countersunk to receive the screws 20 so that the screw head is substantially co-planar with the clubface 16 and an interior portion of the head contacts the clubface 16. The screw 20 is then screwed into the hole. An epoxy glue or other suitable adhesive is used to cement the screw 20 and retain it in position.

In certain embodiments, stainless steel screws 20 are used. The screws 20 are selected so that they are formed of material as hard or harder material than that used to form the club head 14. These screws 20 are also resistant to corrosion. Preferably, the screws 20 have a length that are at least as long as the depth of the holes in the club face 16.

In various embodiments, the screws 20 are configured on the clubface 16 in selected geometric pattern 18*a*-18*f*. By way of non-limiting example, the geometric pattern illustrated in FIG. 2 is a diamond pattern 18*a* with a long axis of the diamond defined in a vertical orientation between a top screw 20 and a bottom screw 20. The top screw 20 and the bottom screw 20 are aligned along a vertical centerline of the sweet spot 22*a* of the club 10. Lateral screws 20 are defined along a lateral centerline of the sweet spot.

Figure 4:
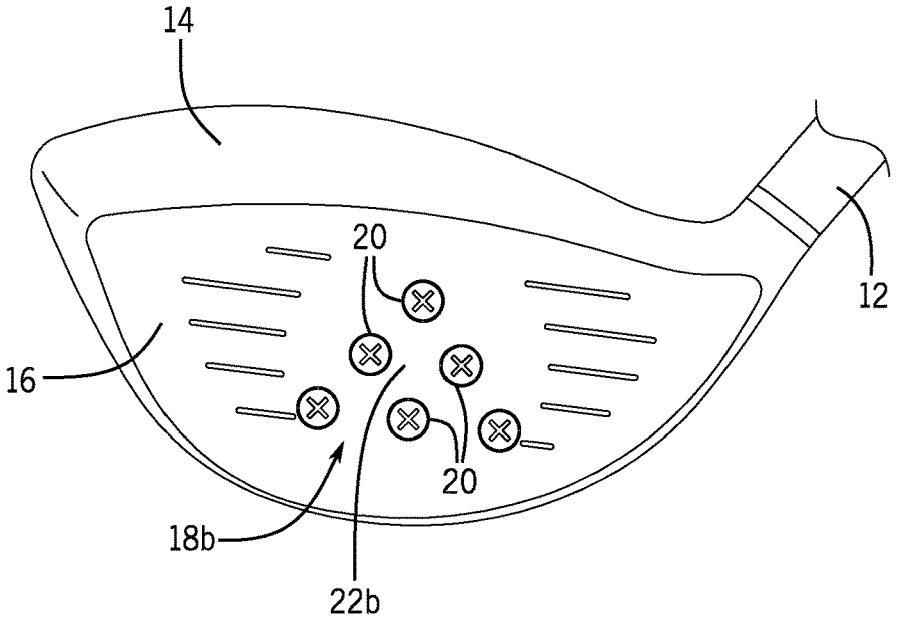
FIG. 4 is a front elevation view of the head of the golf club showing a second embodiment of the clubface.

As seen in reference to FIG. 4, the plurality of screws 20 may be configured in a triangular shaped pattern 18*b*. In preferred embodiments, the base and legs of the triangle may be inscribed within the boundaries of the sweet spot 22*b* of the club face 16, with the base aligned laterally across the bottom of the sweet spot.

Figure 5:
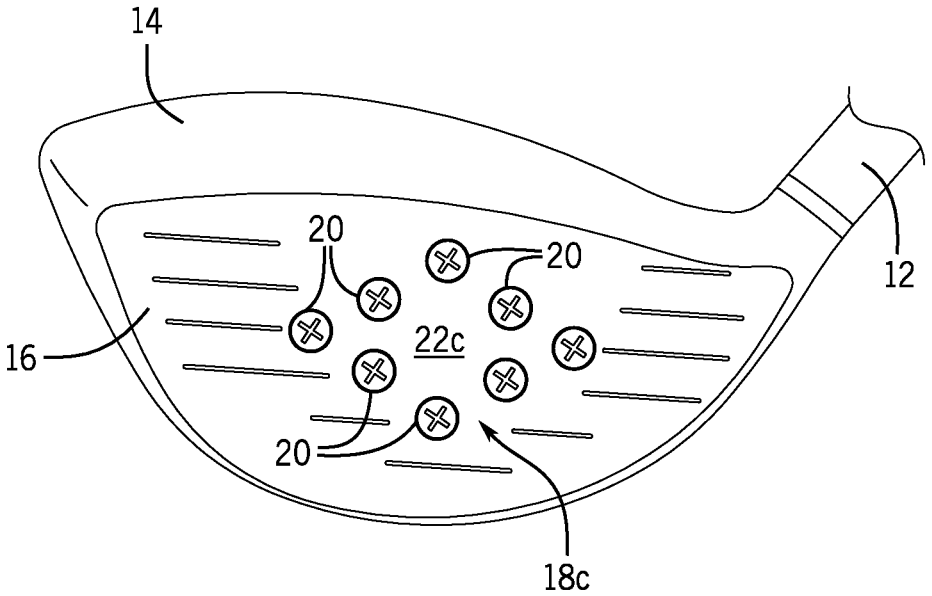
FIG. 5 is a front elevation view of the head of the golf club showing a third embodiment of flathead screws.

As seen in reference to FIG. 5, another non-limiting example of the geometric pattern is shown. In this embodiment, the plurality of screws 20 are arranged in a diamond pattern. In this instance, the long axis of the diamond extends across a lateral centerline of the sweet spot 22*c* with the vertical axis aligned with the vertical axis of the sweet spot 22*c*.

Figure 6:
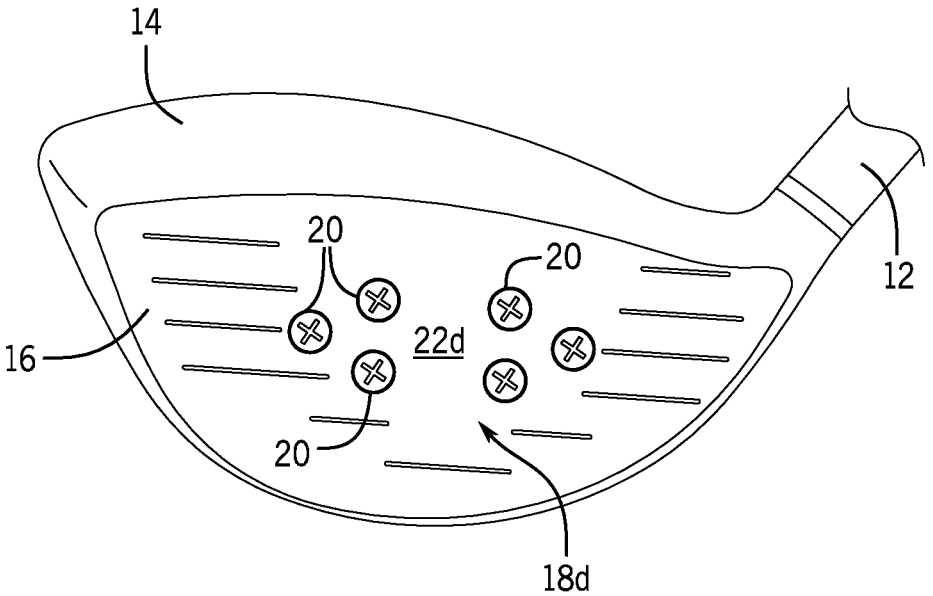
FIG. 6 is front elevation view of a different head of the golf club show a fourth embodiment of the clubface.

As seen in reference to FIG. 6, the selected geometric pattern may include a first geometric shape and a second geometric shape disposed on either side of the vertical center line of the sweet spot 22*d*. In this embodiment, the geometric shapes include triangles with the base of the triangles aligned with a vertical centerline of the sweet spot 22*d* and vertices opposite the base aligned along the horizontal centerline of the sweet spot 22*d*.

Figure 7:
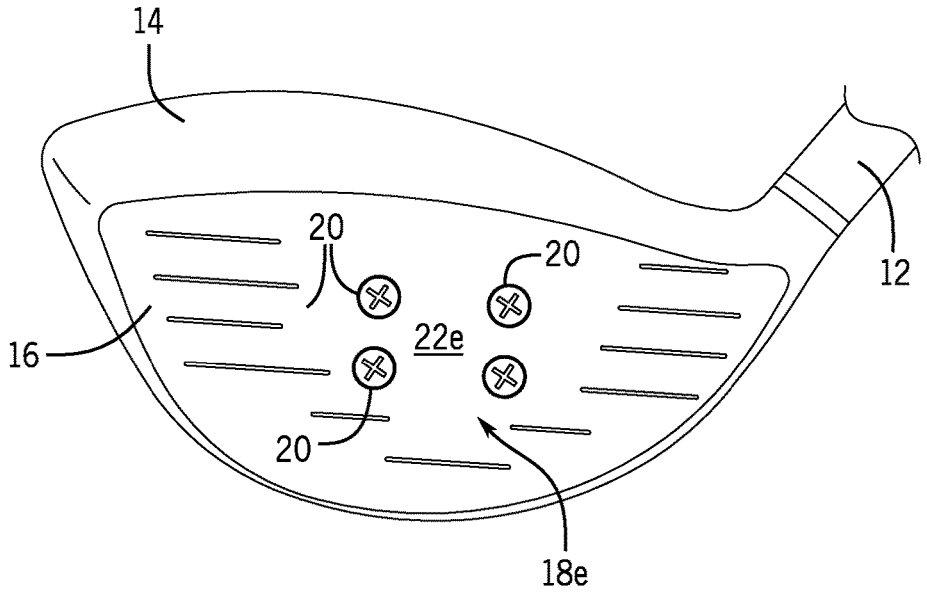
FIG. 7 is front elevation view of a different head of the golf club show a fifth embodiment of clubface.

As seen in reference to FIG. 7, the selected geometric pattern may include a rectangle shape. In this embodiment, the top screws 20 are positioned above a lateral centerline of the sweet spot 22*e* with the bottom screws 20 positioned below the lateral centerline of the sweet spot 22*e*. The left screws 20 and the right screws 20 are positioned on opposite sides of the vertical centerline of the sweet spot 22*e*.

Figure 8:
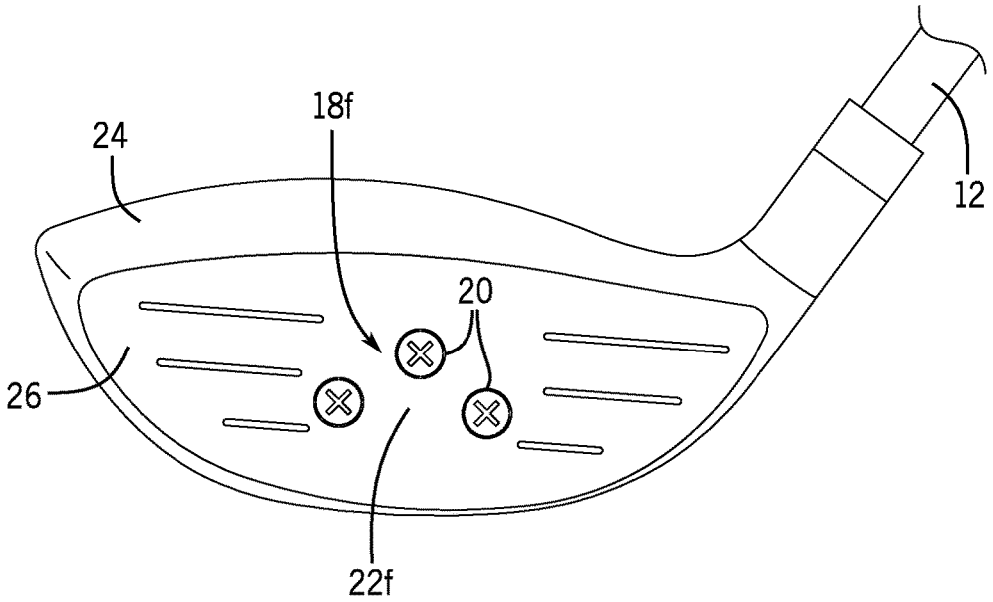
FIG. 8 is front elevation view of a different head of the golf club show a sixth embodiment of the clubface.

A representative fairway metal or hybrid club head 24 is illustrated in reference to FIG. 8. As will be appreciated, the club head 24 in these clubs have a substantially smaller profile than that of the driver. The clubface 27 will have a shorter vertical aspect than its width. In this instance the geometric pattern 18*f* is defined by placement of the screws 20 within a smaller sweet spot 22*f*. In the triangular pattern shown, the base and legs of the triangle 18*f* may be inscribed within the boundaries of the sweet spot 22*f* of the club face 26, with the base aligned laterally across the bottom end of the sweet spot 22*f* and the apex aligned with the vertical centerline of the sweet spot 22*f*.

Advantageously, the improved golf club of the present invention improves consistency of ball contact to the sweet spot 22 of the club 10. It is also believed that by the addition of the plurality of screws 20 in the selected geometric pattern, the sweet spot of the club head 15 is expanded. This results in an optimum ball contact area, and thus, a longer distance shot.

It should be understood, of course, that the foregoing relates to exemplary embodiments of the invention and that modifications may be made without departing from the spirit and scope of the invention as set forth in the following claims. It should be understood, of course, that the foregoing relates to exemplary embodiments of the invention and that modifications may be made without departing from the spirit and scope of the invention as set forth in the following claims.

What is claimed is:

1. A golf club head, comprising:

a body having an exterior sidewall defining an interior cavity;

a heel configured to receive a first end of an elongate shaft;

a clubface defined on an anterior portion of the body oriented for striking a golf ball;

a sweet spot defined in a median portion of the clubface; and a plurality of screws disposed in a geometric pattern about the sweet spot on the clubface.

2. The golf club head of claim 1, wherein the plurality of screws are received in a plurality of threaded, countersunk holes defined through the clubface; and a head of each of the plurality of screws is substantially coplanar with the clubface.

3. The golf club head of claim 2, wherein the plurality of screws have a length at least as long as a depth of the plurality of holes.

4. The golf club head of claim 1, further comprising:

a sweet spot defined in a median portion of the clubface, wherein the plurality of screws are disposed in the geometric pattern about the sweet spot.

5. The golf club head of claim 1, wherein the geometric pattern comprises:

a diamond, wherein a long axis of the diamond is defined in a vertical orientation along a vertical centerline of the sweet spot and a lateral axis of the diamond is defined along a lateral centerline of the sweet spot.

6. The golf club head of claim 1, wherein the geometric pattern comprises:

a triangle, wherein a base and legs of the triangle are inscribed within the boundaries of the sweet spot, and the base aligned laterally across the bottom of the sweet spot.

7. The golf club head of claim 6, wherein an apex of the triangle is aligned with a vertical centerline of the sweet spot.

8. The golf club head of claim 1, wherein the geometric pattern comprises:

a diamond pattern, wherein a long axis of the diamond extends across a lateral centerline of the sweet spot, and a vertical axis of the diamond is aligned with a vertical axis of the sweet spot.

9. The golf club head of claim 1, wherein the geometric pattern comprises:

a first geometric shape and a second geometric shape disposed on either side of a vertical center line of the sweet spot.

10. The golf club head of claim 9, wherein the first geometric shape and the second geometric shape are triangles, with a base of the triangles aligned with a vertical centerline of the sweet spot and vertices opposite the base aligned along a horizontal centerline of the sweet spot.

11. The golf club head of claim 1, wherein the geometric pattern comprises:

a rectangle, with an upper end of the rectangle positioned above a lateral centerline of the sweet spot, a bottom end of the rectangle positioned below the lateral centerline of the sweet spot; and a left side and a right side of the rectangle positioned on opposite sides of a vertical centerline of the sweet spot.

12. A golf club, comprising:

a club head having an exterior sidewall defining an interior cavity, a heel, and a clubface on an anterior portion of the clubface oriented for striking a golf ball, an elongate shaft having a first end and a second end, wherein the first end is received in the heel and the second end is adapted to receive a grip;

a sweet spot defined in a median portion of the clubface; and a plurality of screws are received in the clubface and are disposed in a geometric pattern about the sweet spot.

13. The golf club of claim 12, wherein the plurality of screws are received in a plurality of threaded holes defined in the clubface, a head of each of the plurality of screws are substantially coplanar with the clubface, and the plurality of screws have a length at least as long as a depth of the plurality of holes.

14. The golf club of claim 12, wherein the geometric pattern comprises:

a diamond, wherein a long axis of the diamond is defined in a vertical orientation along a vertical centerline of the sweet spot and a lateral axis of the diamond is defined along a lateral centerline of the sweet spot.

15. The golf club of claim 12, wherein the geometric pattern comprises:

a triangle, wherein a base and legs of the triangle are inscribed within the boundaries of the sweet spot, and the base aligned laterally across the bottom of the sweet spot.

16. The golf club of claim 15, wherein an apex of the triangle is aligned with a vertical centerline of the sweet spot.

17. The golf club of claim 12, wherein the geometric pattern comprises:

a diamond pattern, wherein a long axis of the diamond extends across a lateral centerline of the sweet spot, and a vertical axis of the diamond is aligned with a vertical axis of the sweet spot.

18. The golf club of claim 12, wherein the geometric pattern comprises:

a first geometric shape and a second geometric shape disposed on either side of a vertical center line of the sweet spot.

19. The golf club of claim 12, wherein the geometric pattern comprises:

wherein the first geometric shape and the second geometric shape are triangles, with a base of the triangles aligned with a vertical centerline of the sweet spot and vertices opposite the base aligned along a horizontal centerline of the sweet spot.

20. The golf club of claim 12, wherein the geometric pattern comprises:

a rectangle, with an upper end of the rectangle positioned above a lateral centerline of the sweet spot, a bottom end of the rectangle positioned below the lateral centerline of the sweet spot; and a left side and a right side of the rectangle positioned on opposite sides of a vertical centerline of the sweet spot.

* * * * *